US007503427B2

(12) United States Patent
Toyoshima

(10) Patent No.: US 7,503,427 B2
(45) Date of Patent: Mar. 17, 2009

(54) MUFFLER

(75) Inventor: Youhei Toyoshima, Tokyo (JP)

(73) Assignee: Calsonic Kansei Corporation (JP)

( * ) Notice: Subject to any disclaimer, the term of this patent is extended or adjusted under 35 U.S.C. 154(b) by 336 days.

(21) Appl. No.: 10/783,666

(22) Filed: Feb. 20, 2004

(65) Prior Publication Data

US 2004/0182643 A1 Sep. 23, 2004

(30) Foreign Application Priority Data

Feb. 20, 2003 (JP) ..... P 2003-042392

(51) Int. Cl.
*F01N 1/06* (2006.01)

(52) U.S. Cl. ..... 181/272; 181/249; 181/251; 181/255; 181/257; 181/264; 181/268; 181/275

(58) Field of Classification Search ..... 181/249, 181/255, 264, 272, 251, 257, 268, 275, 265, 181/274
See application file for complete search history.

(56) References Cited

U.S. PATENT DOCUMENTS

| | | | | | |
|---|---|---|---|---|---|
| 2,088,296 | A | | 7/1937 | Kingsley | |
| 2,095,999 | A | * | 10/1937 | Miles | 181/251 |
| 2,290,818 | A | * | 7/1942 | Tyskewicz | 181/265 |
| 3,741,336 | A | * | 6/1973 | Malosh | 181/266 |
| 4,122,914 | A | * | 10/1978 | Suyama | 181/258 |
| 4,192,401 | A | * | 3/1980 | Deaver et al. | 181/266 |
| 4,252,212 | A | * | 2/1981 | Meier | 181/248 |
| 4,360,076 | A | * | 11/1982 | Suyama | 181/265 |
| 4,393,956 | A | * | 7/1983 | Tsukui et al. | 181/265 |
| 4,574,913 | A | * | 3/1986 | Fukuda | 181/231 |
| 4,673,058 | A | * | 6/1987 | Roberts et al. | 181/266 |
| 4,735,283 | A | * | 4/1988 | Macaluso | 181/265 |
| 4,848,513 | A | * | 7/1989 | Csaszar | 181/265 |
| 4,865,154 | A | * | 9/1989 | Hanson et al. | 181/282 |
| 4,901,816 | A | * | 2/1990 | Garey | 181/296 |
| 4,909,347 | A | * | 3/1990 | Wang | 181/272 |
| 5,014,817 | A | * | 5/1991 | Takato et al. | 181/254 |
| 5,025,890 | A | * | 6/1991 | Hisashige et al. | 181/272 |
| 5,560,651 | A | * | 10/1996 | Kami et al. | 280/788 |
| 5,717,173 | A | * | 2/1998 | Gerber et al. | 181/243 |
| 5,959,263 | A | * | 9/1999 | Foltz, Jr. | 181/254 |
| 5,971,098 | A | * | 10/1999 | Suzuki et al. | 181/254 |
| 6,571,911 | B2 | * | 6/2003 | Watanabe et al. | 181/265 |
| 6,629,580 | B2 | * | 10/2003 | Nilsson et al. | 181/265 |
| 2001/0045322 | A1 | * | 11/2001 | Nilsson et al. | 181/227 |

FOREIGN PATENT DOCUMENTS

| | | |
|---|---|---|
| DE | 37 24 087 A | 2/1989 |
| EP | 0 682 172 A | 11/1995 |
| JP | 120214 | 8/1985 |
| JP | 62-054212 | 4/1987 |
| JP | 63-129112 | 6/1988 |

* cited by examiner

*Primary Examiner*—Walter Benson
*Assistant Examiner*—Jeremy Luks
(74) *Attorney, Agent, or Firm*—Kilpatrick Stockton LLP

(57) ABSTRACT

A muffler is capable of sufficiently reducing flow noise, discharge noise, vehicle noise, and cabin noise, preventing a pressure loss, and improving output power. The muffler has a muffler body, an upstream pipe that opens in the muffler body, and a downstream pipe that opens in the muffler body. An opening is formed in a side wall of the downstream pipe in the muffler body. The opening consists of many small holes arranged in an elongated area extending in an axial direction of the downstream pipe.

12 Claims, 6 Drawing Sheets

MUFFLER

BACKGROUND OF THE INVENTION

1. Field of the Invention

The present invention relates to a muffler arranged in an exhaust path for reducing exhaust noise.

2. Description of the Related Art

FIG. 1 shows a muffler according to a related art. In the muffler 50, exhaust gas passes through an upstream pipe 54 and enters a first chamber 51 through small holes 54*a*. Also, the exhaust gas exits from an outlet end of the upstream pipe 54 and enters a second chamber 52. The exhaust gas in the first chamber 51 enters a downstream pipe 55 through an inlet end thereof. The exhaust gas in the second chamber 52 enters the downstream pipe 55 through small holes 55*a* of the downstream pipe 55. The exhaust gas is then discharged into the atmosphere. According to the flow of exhaust gas mentioned above, noise from an engine passes through the upstream pipe 54 and enters the muffler 50. The noise expands when the exhaust gas enters the first chamber 51 through the small holes 54*a* and contracts when the exhaust gas flows into the downstream pipe 55. Also, the noise expands when the exhaust gas enters the second chamber 52 from the upstream pipe 54 and is muffled when the exhaust gas enters the downstream pipe 55 through the small holes 55*a*.

SUMMARY OF THE INVENTION

The muffler 50 of FIG. 1 has many small holes 55*a* in a circumferential direction of the downstream pipe 55, i.e., around the downstream pipe 55, and therefore, is unable to sufficiently reduce vehicle noise and cabin noise and is unable to improve output power. The reason of this will be explained.

Since the small holes 55*a* are provided around the downstream pipe 55, exhaust gas entering the small holes 55*a* forms branch streams in every direction in the downstream pipe 55. Such branch streams widely disturb a flow of exhaust gas in the downstream pipe 55 up to the exit of the muffler 50. This results in insufficiently reducing the kinetic energy of the exhaust gas flow, to unsatisfactorily muffle flow noise, exhaust noise, vehicle noise, and cabin noise.

As shown in FIG. 1, the small holes 55*a* are arranged around the downstream pipe 55, and therefore, exhaust gas flowing into the downstream pipe 55 through the small holes 55*a* is slow in current. Accordingly, the flow passing through the small holes 55*a* is unable to greatly influence a main stream of exhaust gas passing along a central part of the downstream pipe 55. This results in causing a large pressure loss (deteriorating a pressure loss level) and lowering output power.

According to the present invention, a muffler capable of sufficiently reducing flow noise, exhaust noise, vehicle noise, and cabin noise, minimizing a pressure loss, and improving output power is provided.

A technical aspect of the present invention provides a muffler having a muffler body, an upstream pipe with an end that opens in the muffler body, a downstream pipe with an end that opens in the muffler body, and an opening formed in a side face of the downstream pipe in the muffler body, wherein the opening is formed in an elongated area extending substantially along a main axis of the downstream pipe.

DESCRIPTION OF THE PREFERRED EMBODIMENT

Mufflers according to embodiments of the present invention will be explained in detail with reference to the accompanying drawings.

First Embodiment

Figure 1:
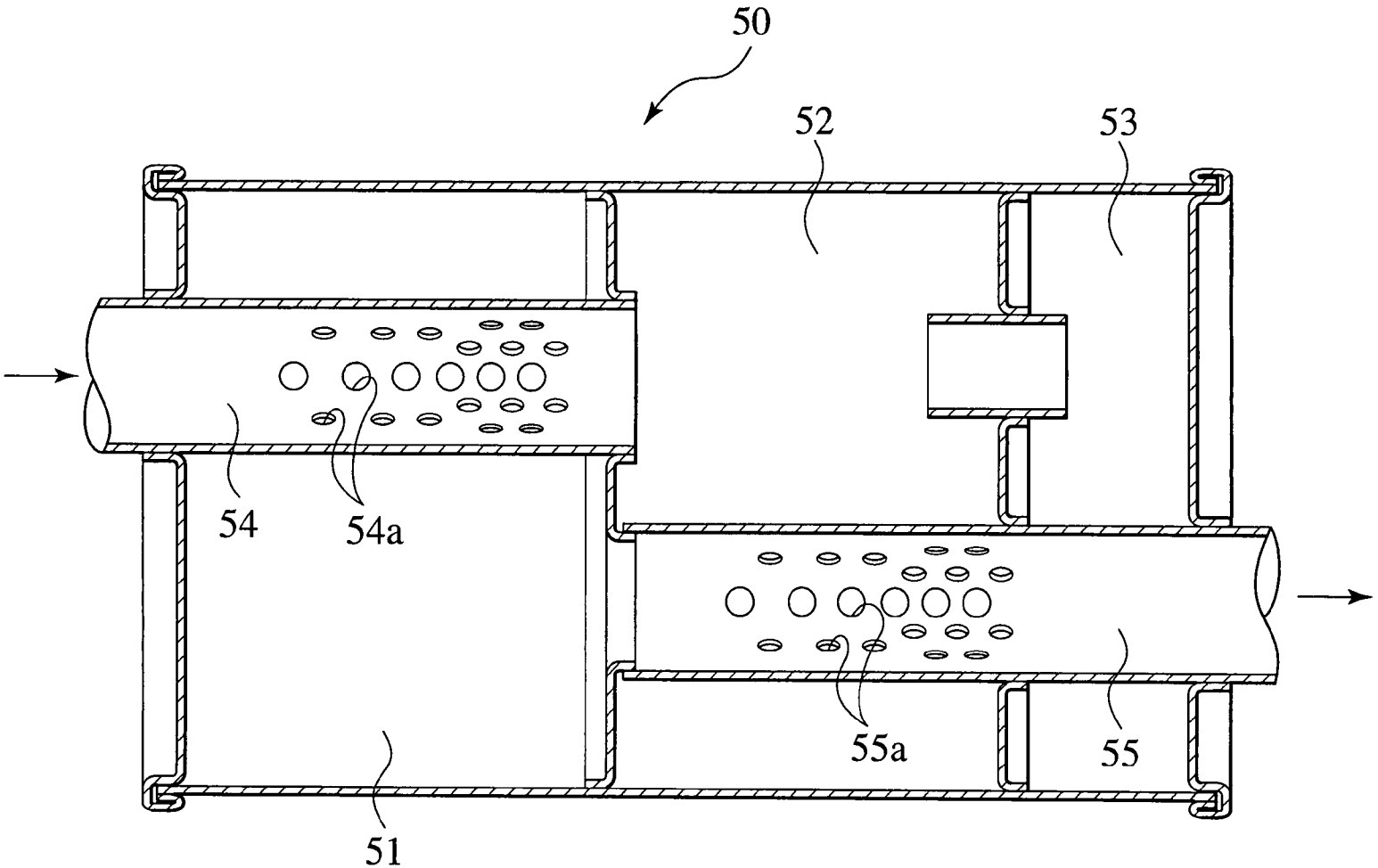
FIG. 1 PRIOR ART
FIG. 1 is a schematic view showing a muffler according to the related art.
Figure 2:
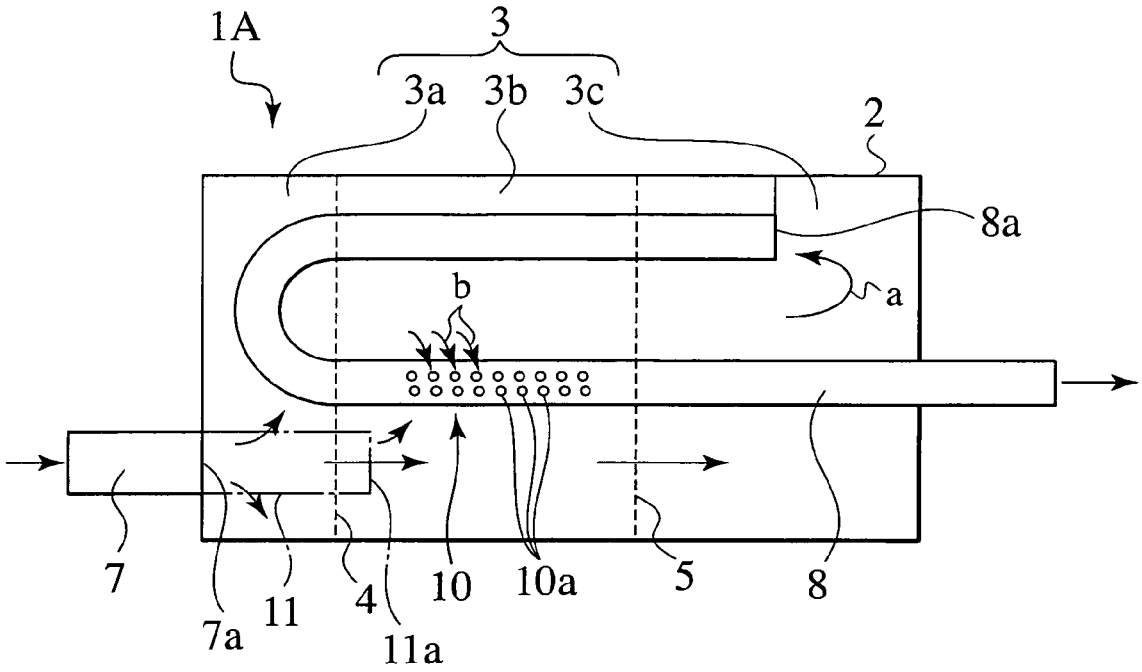
FIG. 2 is a schematic view showing a muffler according to a first embodiment of the present invention.

FIGS. 2 to 5 show a muffler according to the first embodiment of the present invention. In FIG. 2, the muffler 1A has a muffler body 2 as a casing defining a substantially closed space. The muffler body 2 forms an expansion room 3. The expansion room 3 is partitioned with two baffle plates 4 and 5 into first to third expansion chambers 3*a*, 3*b*, and 3*c*. The first expansion chamber 3*a* forms a first acoustic structure that is connected to a second acoustic structure formed of the second expansion chamber 3*b* with the baffle plate 4 serving as an acoustic resistive element being provided between the first and second expansion chambers 3*a* and 3*b*. The second acoustic structure is connected to a third acoustic structure formed of the third expansion chamber 3*c* with the baffle plate 5 serving as an acoustic resistive element being provided between the second and third expansion chambers 3*b* and 3*c*.

The first expansion chamber 3*a* has an opening for passing an end 7*a* of an upstream pipe 7. Through the opening, the upstream pipe 7 discharges exhaust gas into the expansion room 3. A downstream pipe 8 has an end 8*a* being opened in the third expansion chamber 3*c*. Through the opening 8*a*, exhaust gas in the expansion room 3 is discharged. The downstream pipe 8 has a U-shape in such a way that the downstream pipe is extended through the second expansion chamber 3*b* and first expansion chamber 3*a* to the outside.

Figure 3:
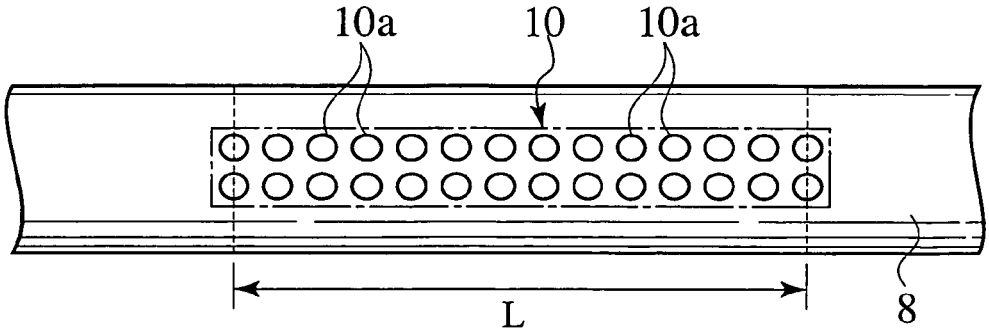
FIG. 3 is an enlarged view showing a pattern of small holes arranged on a downstream pipe of the muffler of the first embodiment.

In the second expansion chamber 3*b*, an elongated area is defined on the side wall of the downstream pipe 8 and is provided with an opening 10. In FIG. 3, the opening 10 consists of many small holes 10*a* that are formed in the elongated area or a belt-like area having a length of L and extending in an axial direction of the downstream pipe 8. In a cross section of the pipe 8, the opening 10 extends in a limited angular range in a circumferential direction. More precisely, in a cross section of the pipe 8, the opening 10 is directionally stretched in the circumferential direction of the pipe 8. Within the belt-like area having the length L, the opening 10 is evenly spread substantially in the axial direction of the pipe 8.

With this arrangement, exhaust gas enters the expansion room 3 from the upstream pipe 7. In the expansion room 3, the exhaust gas expands its volume and is affected by the attenuation interference of shock waves. As a result, flow noise and discharge noise attenuate. Thereafter, the exhaust gas is discharged from the downstream pipe 8. While exhaust gas is running through the muffler 1A, the downstream pipe 8 receives a large amount of exhaust gas through the open end 8*a*. This exhaust gas forms a main flow as depicted by "a" in FIG. 2. At the same time, the downstream pipe 8 receives exhaust gas through the small holes 10*a*, and this exhaust gas forms a secondary flow as depicted by "b in FIG. 2." The main flow "a" and secondary flow "b" interact with each other in the pipe 8 to effectively cancel flow energy. At this time, each of compression waves generated in the main flow and the secondary flow and transmitted therewith interferes with each other to provide an effect of reducing flow noise and discharge noise and preventing a pressure loss.

The small holes 10*a* are directionally distributed in the circumferential direction of the pipe 8 within a limited range having a narrow angle region, and therefore, the secondary flow "b" passing through the small holes 10*a* does not greatly disturb the main flow "a" in the pipe 8 but effectively suppress the generation of flow noise caused by flow disturbance. The opening 10 extended in the narrow circumferential range may improve the interference conditions of compression waves transmitted by the main flow "a" and the secondary flow "b." These factors of the muffler 1A sufficiently reduce flow noise, discharge noise, vehicle noise, and interior noise.

When the secondary flow "b" enters the downstream pipe 8, the secondary flow "b" disperses in the axial direction of the downstream pipe 8 along the main flow "a." Accordingly, the secondary flow "b" entering the downstream pipe 8 through the small holes 10*a* does not disturb the main flow "a" in the pipe 8. Compared with the related art in which small holes are formed in a circumferential direction around a pipe, the first embodiment of the present invention can make the secondary flow "b" larger in a flow rate. The secondary flow "b" and the main flow "a" flowing along a central part of the pipe 8 flow into each other, to improve a pressure loss and increase an output power. The secondary flow "b" joins the main flow "a" in the area having the length of L in the flowing direction of the main flow "a". This widens interference conditions to cancel compression waves in a wide frequency region and reduces noise.

The area of the opening 10 is smaller than that of the related art, to reduce the number of the small holes 10*a* to be formed, thereby decreasing the cost of the muffler 1A. The opening 10 is made of many small holes 10*a*, to preserve the strength of the downstream pipe 8.

Figure 4:
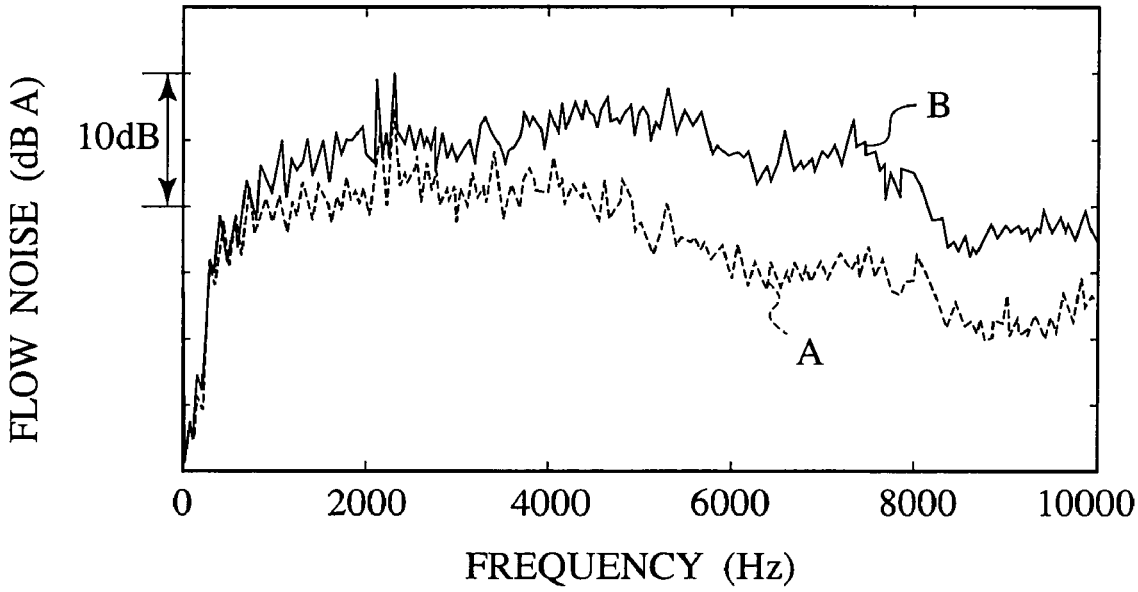
FIG. 4 is a graph showing the flow noise characteristic of a muffler with small holes formed in a circumferential direction according to the related art and that of the muffler of the first embodiment with small holes formed in an axial direction.
Figure 5:
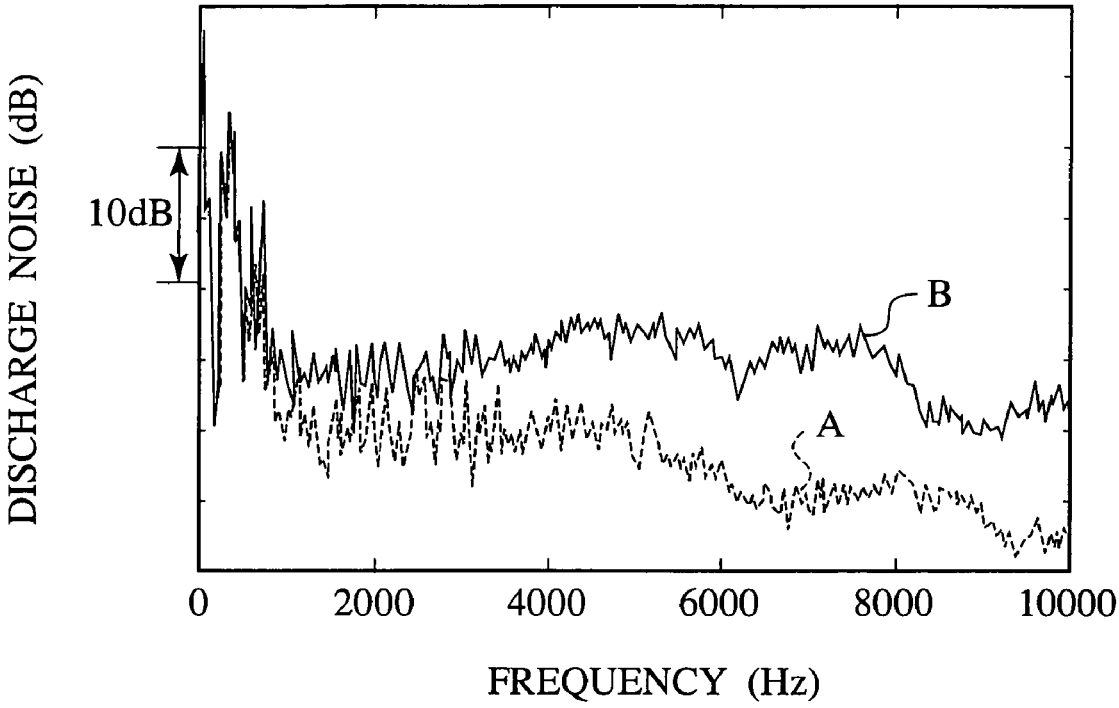
FIG. 5 is a graph showing the exhaust noise characteristic of the muffler with small holes formed in a circumferential direction according to the related art and that of the muffler of the first embodiment with small holes formed in an axial direction.

FIGS. 4 and 5 show measurement results of flow noise and discharge noise of the muffler (A) with the downstream pipe 8 having the small holes 10*a* arranged in an axial direction and the muffler (B) with a downstream pipe having small holes arranged in a circumferential direction. In the measurements, an opening ratio of the small holes 10*a* was 30% of a circumferential part of the pipe 8 where the opening 10 was formed, and a flow rate was 4 $m^3$/min. As is apparent in FIGS. 4 and 5, the muffler of the first embodiment can reduce flow noise and discharge noise more effectively than the related art.

In FIGS. 4 and 5, the muffler of the first embodiment particularly attenuates (about 5 to 10 dB) high-frequency components higher than 4000 Hz, and therefore, is advantageous in reducing accelerating noise and cabin noise. The opening ratio of the small holes 10*a* is preferably in a range from 20% to 40% and more preferably about 30% for sufficiently reducing flow noise and discharge noise.

According to the first embodiment, many small holes 10*a* are formed in an axial direction of the downstream pipe 8. This may change acoustic boundary conditions to decrease the order components of discharge noise. To secure an acoustic boundary, it is preferable to arrange the small holes 10*a* at regular intervals in the axial direction of the downstream pipe 8 (the length direction of the opening 10) and narrow the distance between the adjacent small holes 10*a*.

According to the first embodiment, the small holes 10*a* are arranged in two rows in the circumferential direction of the downstream pipe 8, each row including 14 small holes 10*a* at regular intervals in an axial direction. The number of rows of the small holes 10*a* is optional, for example, one or three on the condition that the rows are arranged in an elongated area extending in the axial direction of the downstream pipe 8. Each row may include an optional number of small holes 10*a*. According to the first embodiment, each small hole 10*a* has a circular shape. The shape may be quadrate, triangular, or any other else. The area where the opening 10 is formed is substantially extended along the main axis of the pipe 8. It is possible to obliquely extend the opening 10 relative to the main axis of the pipe 8.

Second Embodiment

Figure 6:
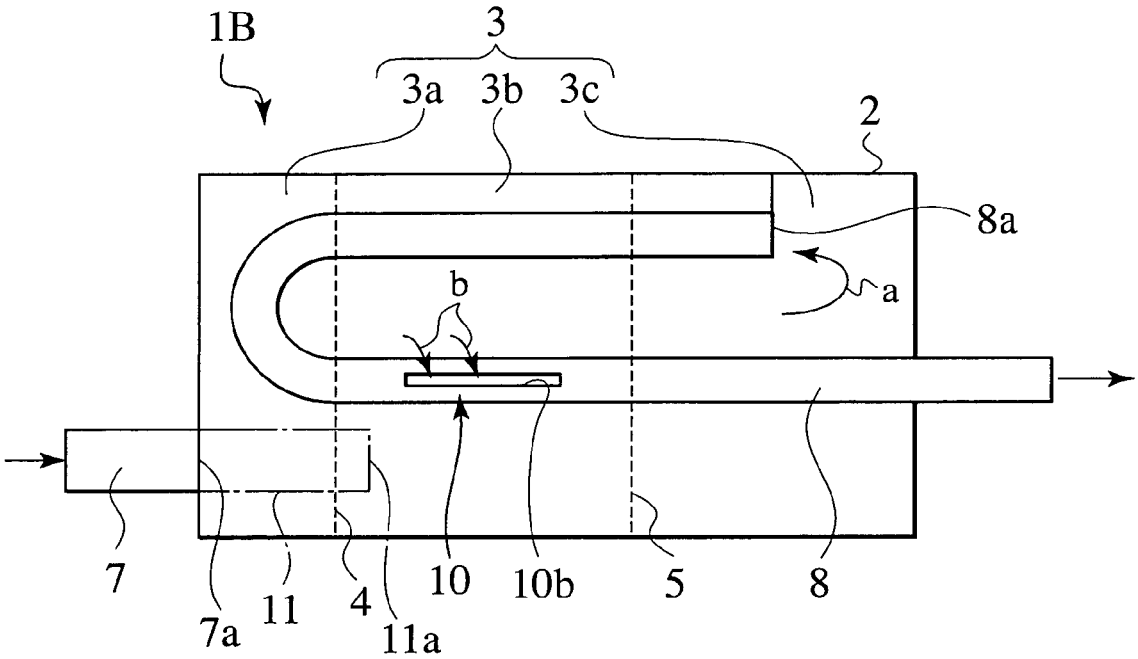
FIG. 6 is a schematic view showing a muffler according to a second embodiment of the present invention.
Figure 7:
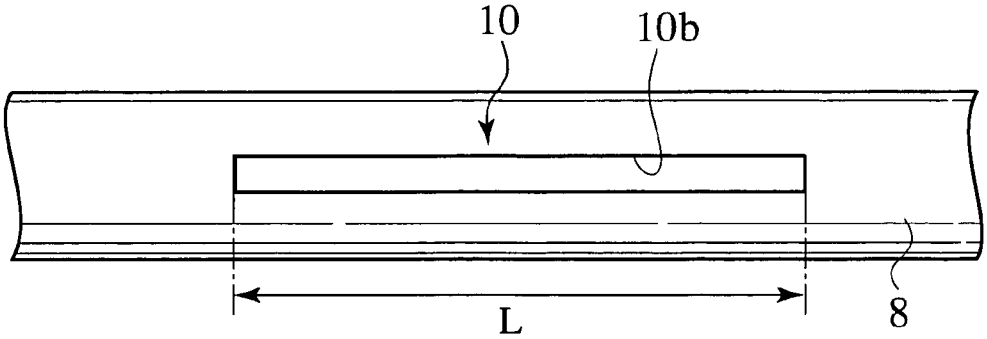
FIG. 7 is an enlarged view showing a slit formed on a downstream pipe of the muffler of the second embodiment.

FIGS. 6 and 7 show a muffler according to the second embodiment of the present invention. FIG. 6 is a schematic view showing the muffler and FIG. 7 is an enlarged view showing an opening 10 formed on a downstream pipe of the muffler.

In FIGS. 6 and 7, the muffler 1B according to the second embodiment has an opening 10 made of a slit 10*b* extending in an axial direction of the downstream pipe 8. The other arrangements of the second embodiment are the same as those of the first embodiment, and therefore, will not be explained in detail. The muffler 1B of the second embodiment provides the same operation and effect as those of the first embodiment.

According to the second embodiment, the slit 10*b* has an elongate shape extending in the axial direction of the downstream pipe 8 and a position thereof changes acoustic boundary conditions to decrease the order components of discharge noise. It is preferable, therefore, to select the position of the slit 10*b* according to acoustic boundary conditions.

The slit 10*b* as shown in FIGS. 6 and 7 is straight. Instead, the slit 10*b* may be elliptic, wavy, or the like. An area of the pipe 8 where the opening 10 is formed substantially extends along the main axis of the pipe 8. The area may be oblique relative to the main axis of the pipe 8. The number of slits 10*b* may be one, two, three, or any other if the slits are formed in an elongated area substantially extending in the axial direction of the downstream pipe 8.

The first and second embodiments allow modifications such as those indicated with virtual lines in FIGS. 2 and 6. Each of these modifications involves an upstream pipe 11 extended into the muffler body 2 and having an end 11*a* that is open in the second expansion chamber 3*b*.

Figure 8:
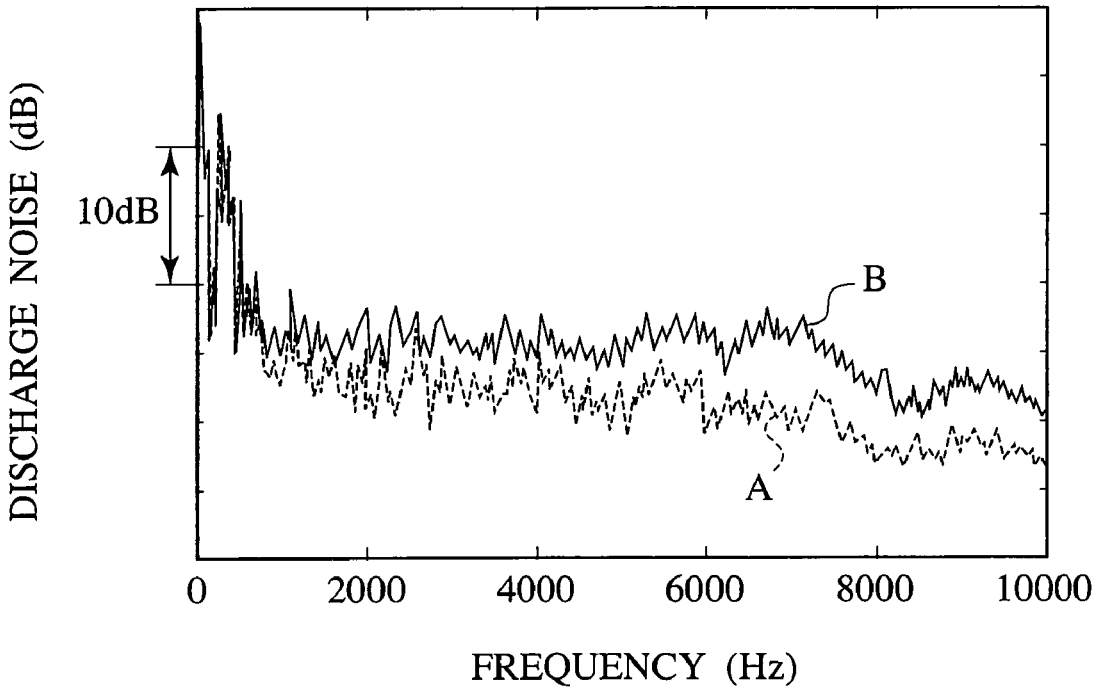
FIG. 8 is a graph showing the exhaust noise characteristic of a muffler with small holes formed in a circumferential direction according to the related art and that of a muffler with an upstream pipe extended into the muffler and with small holes formed in an axial direction (a modification of any one of the first and second embodiments).

The modifications provide the same operation and effect as those of the first and second embodiments. FIG. 8 shows measurement results of flow noise and discharge noise of the muffler (A) with the upstream pipe 11 according to the modification of the first embodiment and the muffler (B) with the downstream pipe having small holes in the circumferential direction of the pipe according to the related art. In the measurements, an opening ratio of the small holes 10*a* of the modification was 30% of the part of the pipe 8 where the opening 10 was formed, and a flow rate was 4 $m^3$/min. As is apparent in FIG. 8, the upstream pipe 11 of the modification is effective to reduce flow noise and discharge noise compared with the related art.

In this way, the muffler according to the present invention forms an opening on a downstream pipe in an axial direction of the pipe so that a secondary flow of discharge gas may flow into the pipe through the opening that is narrow in a circumferential direction of the pipe. This arrangement effectively suppresses flow noise, discharge noise, vehicle noise, and interior noise. The opening is formed in an elongated area that extends in the axial direction of the downstream pipe, and therefore, a secondary flow of exhaust gas flowing into the pipe through the opening is fast. Accordingly, the secondary flow strongly pushes a main flow of exhaust gas flowing along a central part of the pipe, to prevent a pressure loss and improve output power. The area of the opening of the present invention is smaller than that of the related art, to reduce the number of holes to be formed in the opening area and decrease the cost of the muffler.

This application claims benefit of priority under 35USC §119 to Japanese Patent Applications No. 2003-042392, filed on Feb. 20, 2003, the entire contents of which are incorporated by reference herein. Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A muffler comprising:

a muffler body defining an expansion room;

an upstream pipe, an end portion thereof is opened in the expansion room;

a downstream pipe having a first straight pipe portion opened in the expansion room, a second straight pipe portion opened outside of the expansion room, and the first straight pipe portion and the second straight pipe portion being joined together by a curved pipe portion; and an opening formed in a side face of the second straight pipe portion of the downstream pipe in the expansion room, the opening being formed in an elongated area extending substantially along a main axis of the downstream pipe, wherein the end portion of the upstream pipe and an end portion of the first straight pipe portion of the downstream pipe are opened towards the same direction, wherein the opening in the downstream pipe is positioned in an axial direction only between the end portion of the upstream pipe and the end portion of the first straight pipe portion of the downstream pipe, and wherein the elongated area is directionally stretched in a circumferential direction of the downstream pipe and is evenly distributed in a substantial main axis direction of the downstream pipe.

2. The muffler of claim 1, wherein the elongated area is a belt-like area.

3. The muffler of claim 1, wherein the opening comprises a plurality of small holes formed in the elongated area.

4. The muffler of claim 1, wherein the opening comprises a slit formed in the elongated area.

5. The muffler of claim 1, wherein the opening has an opening ratio in a range from 20% to 40%.

6. The muffler of claim 2, wherein the opening has an opening ratio in a range from 20% to 40%.

7. The muffler of claim 1, wherein the opening has an opening ratio of about 30%.

8. The muffler of claim 2, wherein the opening has an opening ratio of about 30%.

9. The muffler of claim 3, wherein the small holes are substantially arranged at regular intervals in a main axis direction of the downstream pipe.

10. The muffler of claim 1, wherein the expansion room of the muffler body is partitioned into a first expansion chamber, a second expansion chamber and a third expansion chamber by a first baffle plate and a second baffle plate.

11. The muffler of claim 10, wherein the opening formed in the side face of the second straight pipe portion opens into the second expansion chamber.

12. The muffler of claim 1, wherein the opening formed in the side face of the second straight pipe portion is the only opening in an outer surface of the downstream pipe.

* * * * *